United States Patent [19]

Jeromin et al.

[11] Patent Number: 4,976,892

[45] Date of Patent: Dec. 11, 1990

[54] PROCESS FOR THE CONTINUOUS TRANSESTERIFICATION OF FATTY ACID LOWER ALKYL ESTERS

[75] Inventors: Lutz Jeromin; Eberhard Peukert; Bernhard Gutsche; Gerhard Wollmann, all of Hilden; Bernard Schleper, Duesseldorf, all of Fed. Rep. of Germany

[73] Assignee: Henkel Kommanditgesellschaft auf Aktien, Duesseldorf, Fed. Rep. of Germany

[21] Appl. No.: 323,517

[22] Filed: Mar. 14, 1989

[30] Foreign Application Priority Data

Mar. 14, 1988 [DE] Fed. Rep. of Germany ..... 3808427

[51] Int. Cl.[5] ..... C11C 3/02

[52] U.S. Cl. ..... 260/410.7; 260/410.6; 560/224; 560/234

[58] Field of Search ..... 260/410.6, 410.7

[56] References Cited

U.S. PATENT DOCUMENTS 4,381,407 4/1983 Bremus et al. ..... 560/263

FOREIGN PATENT DOCUMENTS 2503195 8/1980 Fed. Rep. of Germany .

OTHER PUBLICATIONS

*JOACS,* 59, No. 10, 795A–802A, Oct. 1982.

*Primary Examiner*—Werren B. Lone
*Assistant Examiner*—Vera C. Clarke
*Attorney, Agent, or Firm*—Ernest G. Szoke; Wayne C. Jaeschke; Daniel S. Ortiz

[57] ABSTRACT

A process for the continuous transesterification of $C_6$–$C_{22}$ fatty acid lower alkyl esters, particularly methyl esters, with polyhydric $C_2$–$C_5$ alcohols, particularly glycerol, in a reaction column comprising a rectifying and reaction section, alkaline catalysts and polyhydric alcohol are introduced into the upper part of the reaction column and boiling fatty acid methyl ester is introduced into the middle part of the reaction column. The product collected in the sump of the column is removed, heated and returned to the lower part of the reaction column. Product is removed from the sump. Lower alkanols passing from the reaction column section to the rectifying section are rectified. The reaction column is operated in boiling equilibrium in its lower part and predominantly in an absorption/desorption equilibrium in its upper part.

19 Claims, 1 Drawing Sheet

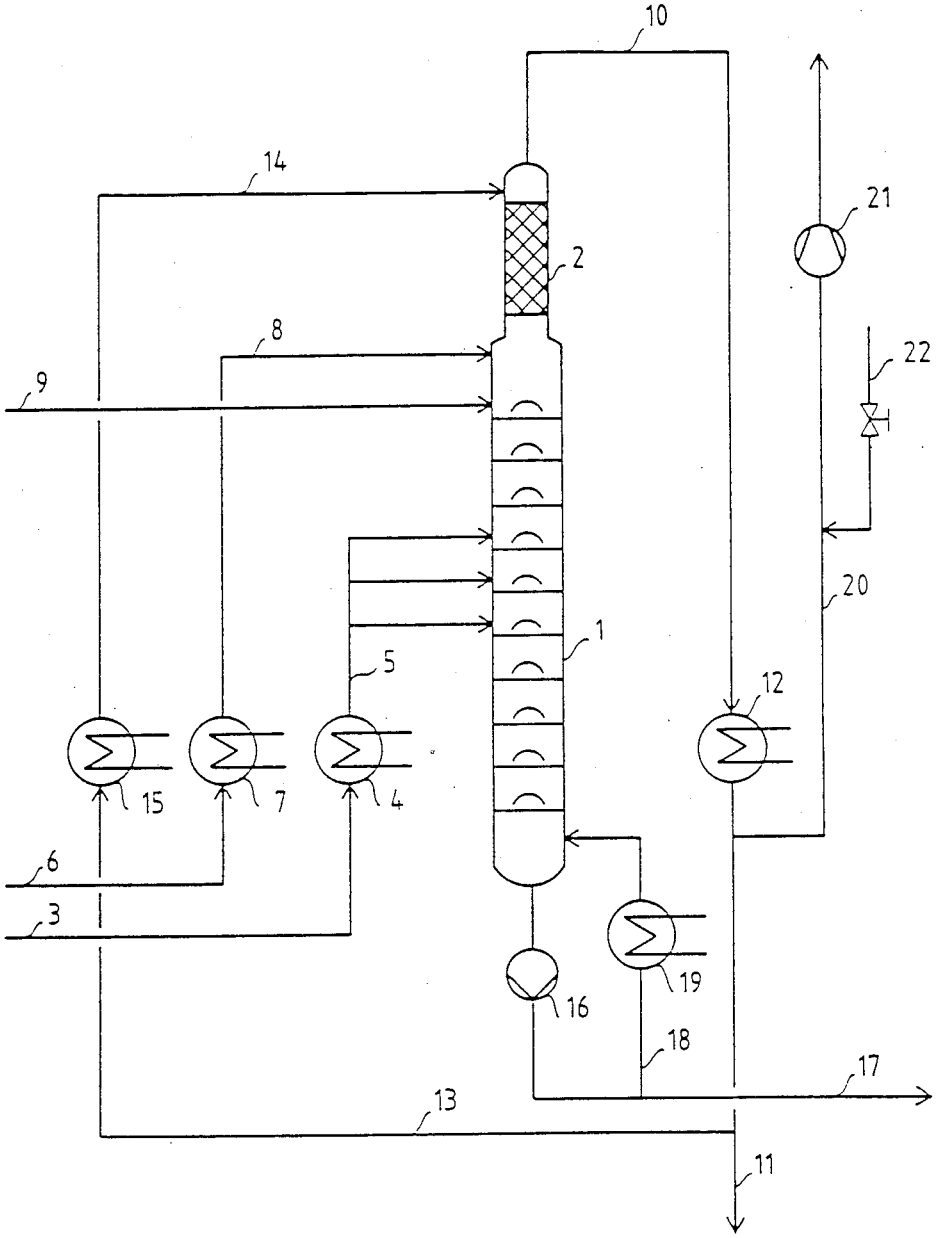
10
14
21
2
8
22
9
20
1
5
12
15
7
4
6
3
19
16
18
17
13
11

PROCESS FOR THE CONTINUOUS TRANSESTERIFICATION OF FATTY ACID LOWER ALKYL ESTERS

BACKGROUND OF THE INVENTION

1. Field of the Invention:

This invention is a process for the continuous transesterification of $C_6$–$C_{22}$ fatty acid lower alkyl esters with polyhdric $C_2$–$C_5$ alcohols in the presence of homogeneous alkaline catalysts.

2. Statement of Related Art:

Hitherto, reactions of methyl esters of fatty acids with polyhydric alcohols, particularly glycerol, have largely been carried out in batch or semi-continuous processes. The end products obtained, particularly triglycerides, may be used as such for a variety of technical applications. Partial glycerides obtained may be converted with water under pressure into fatty acids. The route to fatty acids via the glycerides is advantageous, in relation to the direct saponification of fatty acid esters, because it does not involve any salt pollution of the wastewater.

Transesterification reactions of fatty acid methyl esters with nonohydric alcohols in continuous reaction columns are mentioned in EP-B No. 0 082 301 although there is no reference to any details of the process involved. A synopsis of the transesterification of fatty acid methyl esters with glycerol is published in JAOCS 59, Vol. 10, 795A–802A (1982).

BRIEF SUMMARY OF THE INVENTION

Other than in the operating examples, or where otherwise indicated, all numbers expressing quantities of ingredients or reaction conditions used herein are to be understood as modified in all instances by the term "about".

The process according to the invention comprises:

(a) introducing at least one preheated polyhydric $C_2$–$C_5$ alcohol and an alkaline transesterification catalyst, in solution in a solvent into the upper part of a multiple-plate reaction column, the reaction column operated at a boiling equilibrium in a lower section and predominantly in an adsorption/desorption equilibrium in an upper section, the upper section of the reaction column is in communication with a rectifying zone;

(b) introducing at least one fatty acid lower alkyl ester heated to at least its boiling temperature at the pressure in the reaction column into the middle part of the reaction column and transesterifying the fatty acid lower alkyl ester with the polyhydric alcohol to form lower alkanol, and polyhydric alcohol fatty acid ester;

(c) introducing the lower alkanol into the rectifying zone to provide a rectified lower alkanol;

(d) removing a stream from the lower section of the reaction column at the temperature of said section;

(e) removing a portion of the stream comprising fatty acid lower alkyl ester, polyhydric alcohol, polyhydric alcohol fatty acid esters as product, heating the stream after removal of the product to a temperature above the temperature of the lower section of the reaction column and returning the heated stream to the lower section of the reaction column.

BRIEF SUMMARY OF THE DRAWING

The FIGURE is a diagrammatic representation of an embodiment of the process of the invention.

DETAILED DESCRIPTION OF THE INVENTION

It is possible, by the process according to the invention, to transesterify any of the $C_6$–$C_{22}$ fatty acid lower alkyl esters containing 1 to 5 carbon atoms in the alcohol component. The typical esters encountered include for example ethyl, propyl, butyl or pentyl esters, but preferably the methyl esters of fatty acids of natural, particularly vegetable and animal or sea-animal orgin and also synthetic origin, including the methyl esters of technical fatty acid mixtures of the type obtained, for example, from tallow, coconut oil, soybean oil, palm oil and other vegetable and animal fats. The methyl esters of so-called "first-cut" fatty acids ($C_6$–$C_{12}$), which are obtained in the hydrolysis of fats, are particularly useful.

Basically, any plate column comprising a suitable number of plates, for example sieve plates, may be used in the process of the invention. Particularly suitable columns are bubble plate columns having high liquid levels, preferably double bubble plate columns of the type known, for example, from EP-B No. 0 082 301 and from DE-C 25 03 195 and EP-B No. 0 033 929.

The product removed from the sump of the reaction column is worked up by standard methods, particularly by distillation.

$C_2$–$C_5$ alcohols suitable for use in the invention include ethylene glycol, propylene glycol, glycerol, trimethylolpropane and pentaerythritol; the process is preferably carried out with glycerol.

Suitable catalysts for use in the process of the invention are typical transesterification catalysts, preferably alkali metal alcoholates and hydroxides from the group consisting of lithium hydroxide, sodium hydroxide, sodium methylate and potassium hydroxide. It is preferred to use sodium hydroxide and sodium methylate. Suitable solvents for the catalysts used in accordance with the invention are, in particular, the polyfunctional alkanols which are used for transesterification or those corresponding to the alcohol component of the fatty acid ester to be transesterified. Catalysts, such as NaOH and KOH, may optionally be used, dissolved in small quantities of water.

In one preferred embodiment of the invention, the reaction column is operated at a head pressure of 200 to 700 hPa and more especially at a head pressure of 200 to 300 hPa.

In another advantageous embodiment of the invention, the fatty acid lower alkyl ester is introduced into the column at temperatures of 140° to 240° C. and more preferably at temperatures of 180° to 200° C. and the glycerol at a temperature of 140° to 200° C. and more preferably at a temperature of 160° to 180° C., while the product comprising fatty acid lower alkyl ester, glycerol and fatty acid glycerides, which is returned to the lower part of the reaction column, is introduced at such temperatures that a temperature of 180° to 240° C. and more preferably in the range from 200° to 220° C. is established in the sump of the column. The operating temperature in the middle of the column is in the range from 140° to 200° C. and, at the head of the column, in the range from 30° to 150° C.

In standard esterification processes the more volatile reactant, for example the alcohol is superheated and introduced into the lower part of the reaction column below the first plate to provide an adequate vapor load in the column. In the present process, the more volatile component (fatty acid alkyl ester) is introduced into the middle part of the reaction column at least at its boiling temperature. The process of the invention further provides for an adequate vapor load in the lower section of the reaction column by a partial vaporization of a stream of sump products by forced circulation through a heat exchanger arranged in communication with the sump of the column. Thus, the reaction column operates in boiling equilibrium in its lower part and in absorption/desorption equilibrium in its upper part.

Because the catalyst is added in liquid form at the head of the column, there is a distinct reduction in the temperature of the reactor at the uppermost plates. Head temperatures of 30° to 150° C. are thus established.

The rectifying section of the reaction column, which is generally in the form of a rectifying column, is designed in regard to the number of its plates, that when a methyl ester is transesterified pure methanol is recovered as the head product of rectification, so that there is no need for working up of the distillate. To this end, a corresponding reflux ratio has to be established for methanol, the expert being capable of designing the rectification zone and process parameters.

In another preferred embodiment of the invention, the fatty acid lower alkyl ester and glycerol are introduced into the column in molar ratios of 1:1 to 10:1, depending on the desired end products. In the production of products predominantly containing triglycerides, the fatty acid lower alkyl ester and the glycerol are preferably introduced into the column in molar ratios of from 3:1 to 10:1. If, by contrast, it is intended to produce partial glycerides, the preferred molar ratio of fatty acid lower alkyl ester to glycerol is from 1:1 to 3:1, more preferably from 1.3:1 to 2:1 and most preferably from 1.4:1 to 1.8:1. With non-trifunctional polyhydric alkanols, the molar ratios change according to their functionality.

In another preferred embodiment of the invention, the residence time for the transesterification process, based on the glycerol used, is from 3 to 40 hours.

A preferred process according to the invention is described in detail in the following with reference to the accompanying drawing which is a flow chart of the process for the continuous transesterification of, for example, fatty acid methyl esters.

The plant illustrated in the drawing comprises a reaction column 36 cm in diameter with 30 bubble plates each comprising 10 bubble caps. The rectifying section 2 surmounting the reaction column comprises 2 wire mesh packs made by the Montz company (each 1.1 meter long). The fatty acid methyl ester to be reacted is delivered through a pipe 3 to a heat exchanger 4 and is heated to a boiling or superheated state. The fatty acid methyl ester is then delivered through a pipe 5 to the middle part of the reaction column. The glycerol to be reacted is delivered through a pipe 6 to a second heat exchanger 7, in which it is heated, and is introduced through a pipe 8, along with the catalyst solution through a pipe 9, to the top plate of the reaction column. Methanol removed at the head of the rectifying section 2 is partly removed from the system through pipes 10 and 11 after cooling in a heat exchanger 12 and partly returned as reflux to the head of the rectifying section through pipes 13 and 14 and heat exchanger 15.

The product collected in the sump of the reaction column is partly removed from the system through a pipe 17 by means of a pump 16 and partly returned to the lower part of the reaction column through a return pipe 18 after being heated to a temperature above the sump temperature by means of heat exchanger 19. The system is evacuated through a pipe 20 and a vacuum pump 21, pressure being regulated by means of nitrogen addition through pipe 22.

The invention is illustrated by the following Examples.

EXAMPLE 1:

Transesterification of a first-cut coconut oil methyl ester (approx. 1% $C_6$; 59% $C_8$; 39% $C_{10}$; 1% $C_{12}$), hereinafter referred to as FCME.

The reaction parameters were as follows:

Catalyst feed rate 0.9 kg/hr. (30% by weight solution of sodium methylate in methanol)
FCME feed rate 75 kg/hr.
Glycerol feed rate 29 kg/hr.
Molar ratio of FCME to glycerol 1.5:1
Temperature of the glycerol 170° C.
Temperature of the FCME 200° C.
Head pressure in the reaction column 250 hPa
Sump temperature 230° C.
Ratio of product to recirculating material to sump 1:15
Temperature of recirculated material returned to sump 235°–245° C.

Composition of the sump product: Glycerol 1.9%, FCME 6.5%, remainder fatty acid glycerides. Residence time for glycerol about 8 hrs.

EXAMPLE 2:

Example 1 was repeated with a molar ratio of FCME to glycerol of 1.8:1; the other temperature and pressure parameters remained unchanged. The sump product contained 2.5% glycerol and 9% FCME, remainder fatty acid glycerides.

What is claimed is:

1. A process for the continuous transesterification of a $C_6$–$C_{22}$ fatty acid lower alkyl ester with a polyhydric $C_2$–$C_5$ alcohol in the presence of a homogeneous alkaline catalysts, which comprises:

(a) introducing at least one preheated polyhydric $C_2$–$C_5$ alcohol and an alkaline transesterification catalyst, in solution in a solvent, into the upper part of a multiple-plate reaction column, the reaction column operated at a boiling equilibrium in a lower section and predominantly in an adsorption/desorption equilibrium in an upper section, the upper section of the reaction column is in communication with a rectifying zone;

(b) introducing at least one fatty acid lower alkyl ester heated to at least its boiling temperature, at the pressure in the reaction column, into the middle part of the reaction column and transesterifying the fatty acid lower alkyl ester with the polyhydric alcohol to form lower alkanol, and polyhydric alcohol fatty acid ester;

(c) introducing the lower alkanol into the rectifying zone to provide a rectified lower alkanol;

(d) removing a stream from the lower section of the reaction column at the temperature of said section;

(e) removing a portion of the stream comprising fatty acid lower alkyl ester, polyhydric alcohol, polyhydric alcohol fatty acid ester as product, heating the stream after removal of the product to a temperature above the temperature of the lower section of the reaction column and returning the heated stream to the lower section of the reaction column.

2. A process of claim 1, wherein the polyhydric $C_2$–$C_5$ alcohol is glycerol.

3. A process of claim 1 wherein the fatty acid lower alkyl ester is the methyl ester.

4. A process of claim 1 wherein the catalyst comprises at least one member selected from the group consisting of lithium hydroxide, sodium hydroxide, sodium methylate and potassium hydroxide.

5. A process of claim 1 wherein the reaction column is operated at a head pressure of from about 200 to about 700 hPa.

6. A process of claim 5 wherein the head pressure is from about 200 to about 300 hPa.

7. A process of claim 2 wherein the fatty acid lower alkyl ester is introduced into the reaction column at a temperature of from about 140° to about 240° C. and the glycerol is introduced into the reaction column at a temperature of from about 140° to about 200° C. and the product comprising fatty acid lower alkyl ester, glycerol and fatty acid glyceride, which is returned to the lower part of the reaction column is introduced at a temperature of from about 180° to about 240° C.

8. A process of claim 1 wherein the transesterification is carried out at a temperature in the range from 140° to 200° C. in the middle part of the reaction column and the temperature in the upper part of the reaction column is in the range of from about 30° to about 150° C.

9. A process of claim 1 wherein the fatty acid lower alkyl ester and glycerol are reacted in a molar ratio of 1:1 to 10:1.

10. A process of claim 1 wherein the product comprises predominantly triglyceride, and the fatty acid lower alkyl ester and glycerol are reacted in a molar ratio of from about 3:1 to about 10:1.

11. A process of claim 1 wherein the product comprises predominantly partial glyceride, and the fatty acid lower alkyl ester and glycerol are reacted in a molar ratio of from about 1:1 to about 3:1.

12. A process of claim 11, wherein the product comprises predominantly partial glyceride, and the fatty acid lower alkyl ester and glycerol are reacted in a molar ratio of from about 3:1 to about 2:1.

13. A process of claim 11 wherein the product comprises predominantly partial glyceride, and the fatty acid lower alkyl ester and glycerol are reacted in a molar ratio of from about 1.4:1 to about 1.8:1.

14. A process of claim 1 wherein the residence time for the transesterification is from about 3 to about 40 hours.

15. A process of claim 1 wherein the transesterification catalyst is in solution in the polyhydric alcohol.

16. A process of claim 1 wherein the transesterification catalyst is in solution in a lower alcohol.

17. A process of claim 1 wherein the transesterification catalyst is in solution in methanol.

18. A process of claim 1 wherein the transesterification catalyst is an alkali metal hydroxide and is introduced into the column in solution in water.

19. A process of claim 16 wherein the lower alkanol is the lower alkanol of the fatty acid lower alkanol ester.

* * * * *

UNITED STATES PATENT AND TRADEMARK OFFICE

CERTIFICATE OF CORRECTION

PATENT NO. : 4,976,892

DATED : December 11, 1990

INVENTOR(S) : Lutz Jeromin et al.

It is certified that error appears in the above-identified patent and that said Letters Patent is hereby corrected as shown below:

At Claim 1, Column 4, line 46, "catalysts" should read --catalyst--.

Signed and Sealed this

Twenty-third Day of June, 1992

*Attest:*

DOUGLAS B. COMER

*Attesting Officer*

*Acting Commissioner of Patents and Trademarks*